United States Patent [19]

Wens

[11] 4,295,824

[45] Oct. 20, 1981

[54] SYSTEM FOR SEALING OF KILNS

[75] Inventor: Johannes C. Wens, Nijmegen, Netherlands

[73] Assignee: Smit Ovens Nijmegen B.V., Nijmegen, Netherlands

[21] Appl. No.: 85,526

[22] Filed: Oct. 17, 1979

[30] Foreign Application Priority Data

Oct. 25, 1978 [DE] Fed. Rep. of Germany ..... 2846387

[51] Int. Cl.[3] ..... F27B 7/24; F27D 1/18; F26B 25/00

[52] U.S. Cl. ..... 432/115; 34/242; 432/242

[58] Field of Search ..... 432/115, 138, 242; 34/242

[56] References Cited

U.S. PATENT DOCUMENTS

| | | | |
|---|---|---|---|
| 1,620,989 | 3/1927 | Agthe | 432/115 |
| 3,584,885 | 6/1971 | Oberndorfer | 277/82 |
| 3,940,239 | 2/1976 | Rossi et al. | 432/115 |

FOREIGN PATENT DOCUMENTS

| | | | |
|---|---|---|---|
| 588339 | 11/1933 | Fed. Rep. of Germany | 34/142 |
| 1202207 | 9/1965 | Fed. Rep. of Germany . | |
| 650259 | 1/1929 | France | 432/115 |
| 1201999 | 7/1959 | France . | |

*Primary Examiner*—John J. Camby

*Attorney, Agent, or Firm*—Fitch, Even, Tabin, Flannery & Welsh

[57] ABSTRACT

A sealing assembly for a rotary kiln or furnace is achieved with a pair of outer sealing rings urged into a pressured sealing engagement by a barrier gas provided at a predetermined pressure from a burette. An internal intermediate ring, preferably formed of a graphite fiber material serves as an inner seal against the direct transfer of internal gases and heat to the outer sealing rings which provide the final sealing against gas escaping during rotation of the inner work support means relative to the outer stationary supporting means. The intermediate ring also acts as a bearing and as a spacer and absorbs compression forces between the turning inner chamber, or grate, and the outer stationary supporting means.

9 Claims, 4 Drawing Figures

SYSTEM FOR SEALING OF KILNS

The present invention relates to an assembly for sealing furnaces or kilns having rotary chambers or rotary grates (tables) for the material to be heated or burnt, for instance cylindrical rotary furnaces and rotary grate kilns.

Cylindrical rotary furnaces and rotary grate (drier) kilns are in widespread use, and have been known for many years. Such furnaces or kilns are used, for example, for producing cement, for drying the most varied materials, and for incinerating mixtures difficult to burn, such as household or special refuse. The present invention for the sealing of furnaces or kilns of this type is useful or many kinds of such furnaces or kilns; in particular, it may be used with advantage in cylindrical rotary furnaces or kilns, e.g. for refuse incineration. During processing of the refuse, gaseous substances are released which must be exhausted or removed and which, in part, may be used as fuel gas.

More particularly, it is the object of the present invention to seal both the combustion chamber and the input (feeding) and output (discharge) sections during rotation of the rotary tube or cylinder. The gaseous substances released partially include substantial amounts of contaminants and poisonous components, e.g. hydrogen halides, such that sealing is of paramount importance in order to avoid harmful emissions.

The solution to this problem is aggrevated by the fact that with the advance in the art increasingly greater mechanisms are employed, whereby the sealing problems increase over-proportionally due to the large diameters which are required in such mechanisms. Furthermore, both the axial and the radial expansion of the cylinder being heated to about 1000° C., relative to the cold condition thereof, must be compensated for.

Accordingly, it another object of the present invention to provide an improved sealing assembly or system for furnaces or kilns having rotary compartments and turntables or rotary grates, which assembly even in the case of large-size mechanisms and at high temperatures provides for absolutely secure and low-wear sealing, and which is insusceptible to failure and requires little maintenance, while at the same time not affecting the economical furnace or kiln construction.

According to the present invention, this object is solved by sealing sleeves adapted to be urged into pressure contact by means of a pressurized medium and being disposed in an area on a rotating seal portion or a stationary seal portion being, in turn shielded by insulation, cooling and/or packings of a heat resistant material, and means adapted to permit sealing movement relative to of the sealing faces on the rotating furnace portion; and by the fact that an intermediate ring is mounted between said rotating and stationary seal portions.

In order to absorb the pressure (compression) forces acting between the rotating and the stationary furnace or kiln portion, an intermediate ring is provided between this portions. Preferably, this intermediate ring is formed of graphite fibers. This material is highly heat resistant and of sufficient strength to absorb the forces involved. On the other hand, this material is pliable, such that the intermediate ring forms a first seal or gasket which, however, still allows some gas to pass therethrough. Therefore, the intermediate ring acts as a spacer ring, a sealing ring and a friction or sleeve bearing.

In order to obtain an absolutely secure gas sealing arrangement, said sealing sleeves being positioned in recesses, are urged into pressure contact by a barrier gas under increased pressure relative to the interior of the furnace or kiln.

Most preferably, a pair of concentric sealing sleeves are provided which have, in cross-section, an asymmetrical, angular profile, with the apex of each angle contacting said sealing face, wherein the longer leg of the angle of said inner sealing sleeve and the shorter leg of said outer sealing sleeve are directed towards the interior of the furnace or kiln. This configuration of the sealing sleeves provides the effect that the outer (longer) leg of the sleeve is pressed into tighter contact than the inner leg. Through a small aperture in the web positioned between said two sealing sleeves, barrier gas enters the space between both sealing sleeves. In this way, this space is scavenged by the barrier gas.

Accordingly, as the pressure of the barrier gas is increased over the pressure existing interiorly of the furnace or kiln, barrier gas only is allowed to enter the furnace compartment if small leakage losses occur, whereas harmful gases are positively prevented from flowing out. Advantageously, the barrier gas is replenished from a plunger-loaded burette including an alarming device. In this way, a leaking state may be easily detected by increased barrier gas consumption. Of course, it is also possible to burn the released gases or to use them as fuel gases if these gases are suitable to this purpose.

In order to reduce the thermal load on the sealing sleeves, it is advantageous to provide a cooling water channel on the periphery of the stationary furnace portion, preferably closely adjacent to the sealing sleeves.

An embodiment of the present invention is illustrated in the enclosed drawings, wherein.

Figure 1:
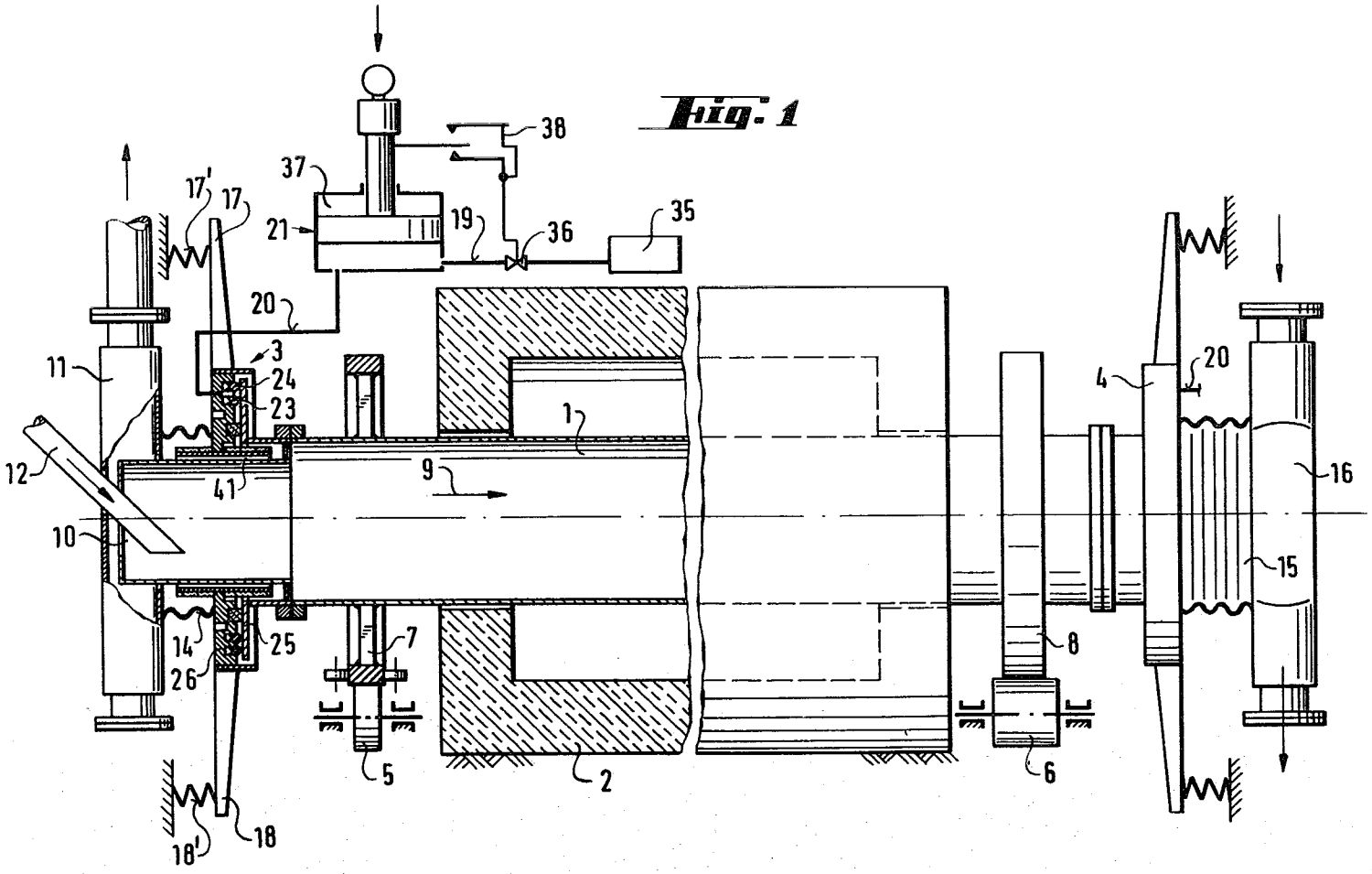
FIG. 1 shows a schematical sectional view of a cylindrical rotary furnace or kiln including the sealing assembly according to the present invention.

As shown in the Figures, sealing or gasket means are employed in conventional cylindracal rotary furnaces or kilns having a rotary tube or cylinder 1 and a housing 2. A total of two sealing means 3 and 4 are positioned in the joints between the cylinder and the input and output (feeding and discharging) portions, respectively, of the furnace.

The cylinder 1 is rotated through supporting wheels 5, 6 and corresponding (associated) peripheral wheels 7, 8, with at least part of these wheels being driven. In this construction, the supporting wheels are dimensioned and arranged in such a manner that thermal expansion of the cylinder in operation may be absorbed. The technology required to this end is well known. The direction of flow through the cylindricyl rotary furnace or kiln is indicated by arrow 9. The inlet (feed) port 10 of the cylinder 1 is surrounded by a scavenging box 11 from which the gases escaping from the inlet port 10 may be removed. Further, a feed pipe 12 may be inserted into the inlet port 10, through which pipe the disintegrated material to be incinerated may be supplied. This feed pipe may be sealed separately. As this feed pipe does not become particularly hot, sealing thereof is not critical.

The scavenging box 11 is stationary with respect to the cylinder 1, and it is tightly connected to the rotary portions of the sealing means 3 with the aid of a sealing bellows 14. A similar bellows, although of slightly larger dimensions, is disposed at the outlet or discharge end 15 of the cylinder. This end is connected to a discharge box 16 through which the incinerated or ashed product is discharged, accompanied by scavenging gases. In view of the fact that the sealing means 3 and 4 at the opposite ends of the cylinder are substantially identical, it is sufficient to describe one of these means only.

Both bellows, preferably formed of corrosion resistant metal, represent both a gasket and a device for producing a resilient force to press the stationary seal portion 26 against the rotary seal protion 25. A further pressure device is formed by stabilizing arms 17. 18 which, through spring means 17', 18', react against a stationary wall and thereby urge the sealing means of the cylinder towards the center of the latter.

As will be explained below, the increased pressure contact of sealing sleeves 23, 24 requires a barrier gas. This barrier gas is fed under pressure between the sealing sleeves 23, 24 through a passage communicating via a conduit 20 with a plunger-loaded leakage gas compensation chamber (burette 21). Through another conduit 19, a barrier gas is received under pressure from a reservoir 35, which gas is supplied to the burette 21 through a valve 36. A piston-cylinder assembly 37 operates to impart a fixed pressure to the barrier gas. In the case of increasing barrier gas loss, the piston lowers, thereby initiating by means of a switch assembly 38 an electric signal for opening the valve 36. In such case, replenishing barrier gas is pressure-fed from the reservoir 35, such that the piston rises again to thereby re-close the valve 36 through a second switch contact. In this construction, it is possible to control by means of electric circuits the monitoring circuit in such a way that a signal is generated in the case of extremely high leakage losses of gas, i.e. in the case of a high switching sequence. Likewise, a signal may be released if the upper contact is not closed sufficiently fast with the valve 36 being open, which state would also indicate increased leakage loss of gas or a depleted reservoir. As barrier gases, inert gases resulting from combustion, pure nitrogen, argon or noble gas mixtures being known per se in chemical technology, are useful.

Figure 2:
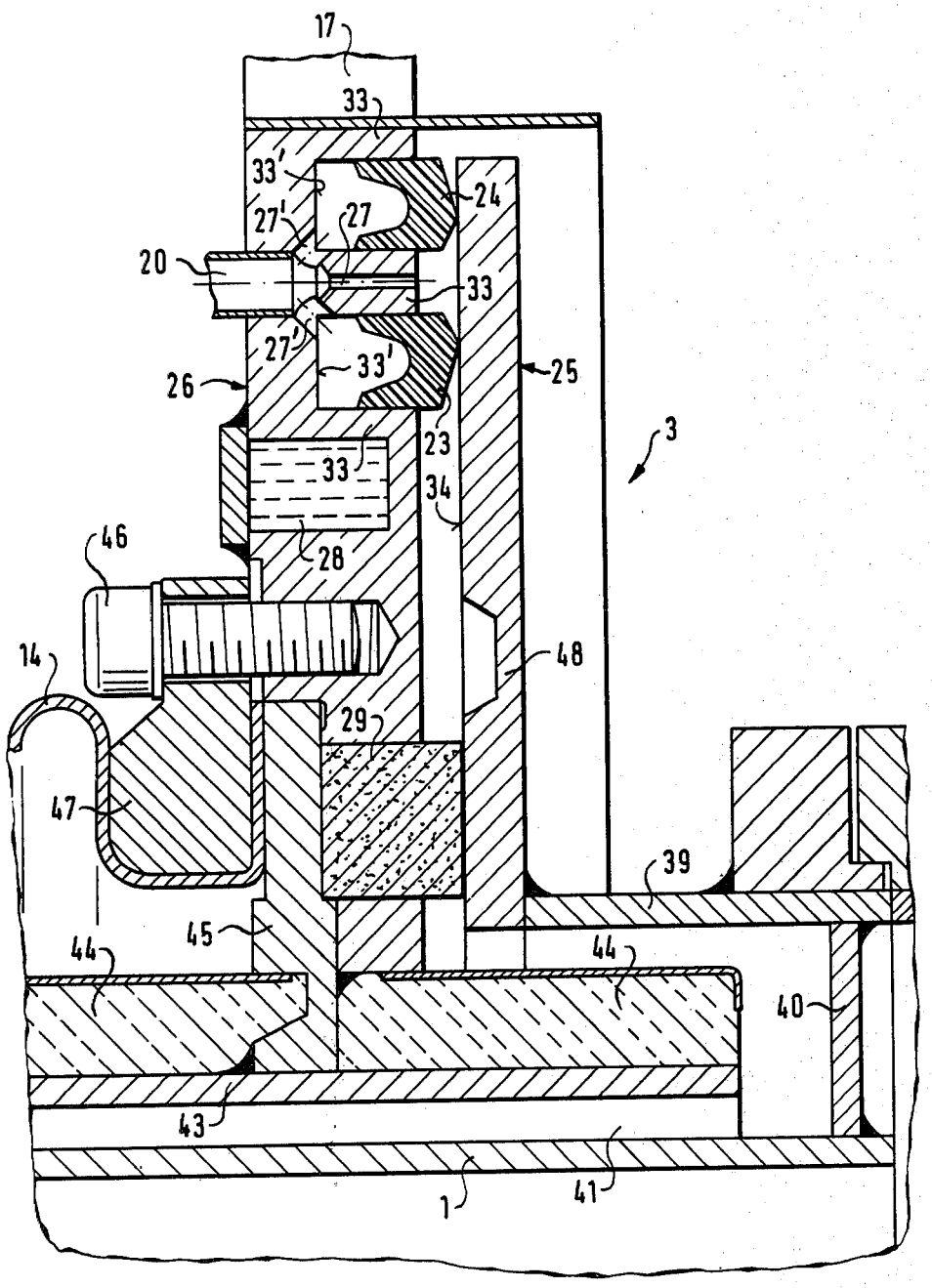
FIG. 2 is a detailed sectional view of the sealing assembly.

FIG. 2 illustrates in detail the structure of the sealing means 3. The sealing means or assembly according to the invention comprises essentially an inner sealing sleeve 23 and a concentrically mounted outer sealing sleeve 24 between the rotating and stationary seal or gasket portions 25 and 26, respectively. The rotating portion 25 comprises an annular disc mounted in concentric relation to the furnace axis and connected to the cylinder 1 through a bushing 39 and a flange 40. The cavity 41 produces by these parts communicates with the interior of the furnace and the inlet port 10. On the other hand, as the stationary seal portion 26, there is provided a collar-like device composed of a short pipe section 43 having an insulating composition 44 applied exteriorly or interiorly thereto and to which an annular disc-shaped mounting part 45 is securely mounted. This mounting part is in pressure contact with the abovementioned bellows 14 which is connected to the stationary seal portion 26 by means of a bolt 46 with the interposition of a mounting ring 47.

The sealing sleeves 23, 24 are slidably positioned in annular recesses 33' defined by webs 33, and these sleeves are urged against the sealing face 34 of the rotating seal portion 25 by the barrier gas. Through a small-diameter supply port 27 and further supply ports 27', barrier gas enters from conduit 20 the space between the sleeves 23, 24 such that these sleeves are forcefully urged into pressure contact with the sealing face 34. Owing to the pressure gradient with respect to atmospheric pressure (outerside) or furnace atmosphere pressure (innerside), the outer sleeve is urged into pressure contact with a higher force than the inner sleeve, whereby sealing is substantially improved, too. Still further, the barrier gas has the function of entraining and neutralizing minor amounts of leakage gas.

Immediately adjacent to the sealing sleeves 23, 24, a cooling water channel or passage 28 is provided in the stationary furnace portion 26. Still further, an essential feature resides in the intermediate ring 29 being positioned between the mounting part 45 and the rotating seal portion 25. Ring 29 forms a first seal and absorbs the pressure forces acting between the rotating and stationary portions 25 and 26, respectively. In this connection, bellows 14, 15 take up the axial thermal expansion of the cylinder 1. The radial expansion is permitted to occur by sliding movement of the sealing sleeves 23, 24 and the intermediate ring 29 relative to the sealing face 34.

In order to provide for as low as possible a heat transfer from the stationary seal portion to sleeves 23, 24, portion 25 is provided with a reduced section 48.

Graphite of high heat resistance is used as the material for the intermediate ring 29. However, this ring does not actually perform a sealing function, but rather serves essentially to absorb pressure. The sealing function as such is provided by the sealing sleeves 23, 24 which are preferably formed from a highly heat resistant fluorohydrocarbon elastomer. Materials of this type (trademark VITON) are thermally resistant at temperature of up to 300° C. Furthermore, the sealing assembly is constructed such that heat of radiation and conduction is prevented from contacting the sealing sleeves as far as possible. If necessary, amounts of heat are removed by cooling.

The asymmetry and mirror-image arrangement of the sealing sleeves 23, 24, as appears in FIG. 2, wherein the longer leg of the angle of the inner sealing sleeve 23 and the shorter leg of the angle of the outer sealing sleeve 24 are directed toward the interior of the furnace or kiln, provides for further, surprising improvement of the sealing function when the pressurized barrier gas is fed under pressure into the space between the sealing sleeves.

On the whole, the sealing assembly according to the present invention represents an efficient, trouble-free and secure solution to the object as outlined at the beginning.

Figures 3, 3A:
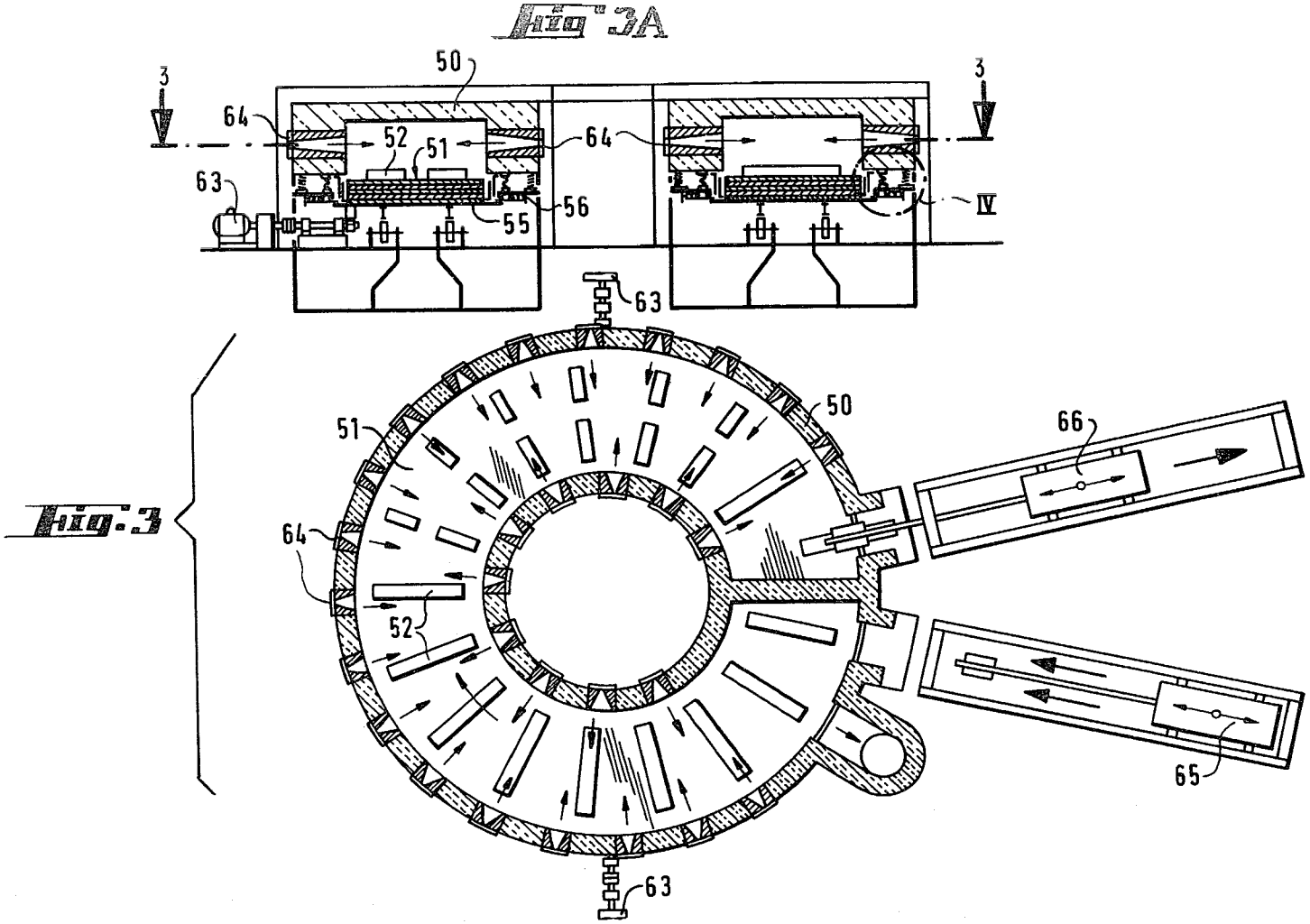
FIG. 3 illustrates the use of the present invention in a rotary grate or turnable furnace or kiln.

FIG. 3 illustrates the use of the present sealing assembly in a furnace or kiln operating in accordance with the so-called carousel principle (rotary grate furnace or kiln). FIG. 3 shows a sectional view in its upper part and a plan view of the furnace or kiln in its lower part. The furnace comprises a rotary grate or turntable 51 upon which objects 52 to be treated have been placed. Through an electric motor and a gear rim 63, the turntable is driven in rotation, and the chamber 50 above the turntable is heated by means of burners 64. Disposed at the periphery of the furnace are a charging machine 65 and a discharging machine 66. The rotating turntable 51 must be sealed relative to the stationary chamber 50. To this end, there may be used on principle the above-described sealing assembly which is shown in FIG. 2 as applied to a cylindrical rotary furnace. To this end, same as in FIG. 2, a rotating furnace portion (55) and a stationary furnace portion (56) have to be considered.

Figure 4:
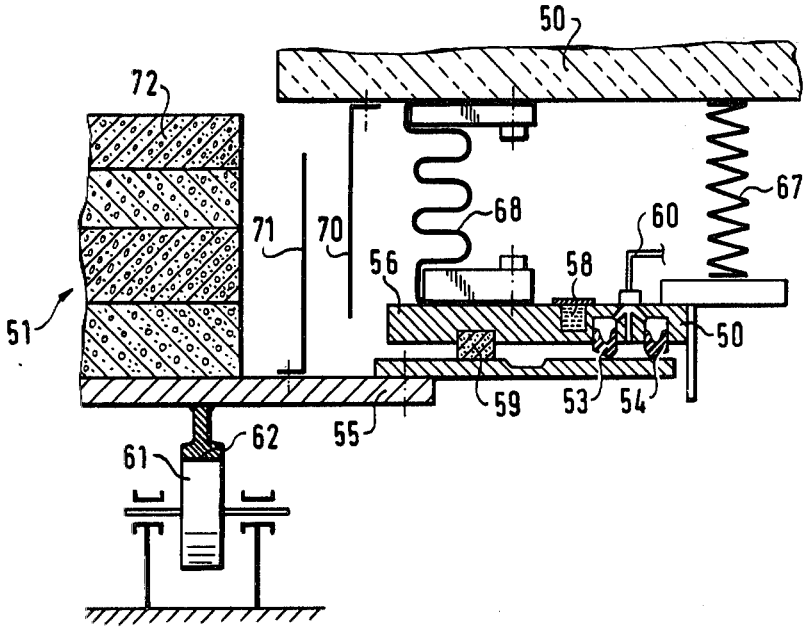
FIG. 4 shows a detail of FIG. 3.

For better illustration, the detail of the rotary grate furnace or kiln as encircled in FIG. 3 and including the seal is more particularly shown in FIG. 4. The turntable 51 is supported by a rail 62 through a wheel 61. In this construction, the rotating furnace portion 55 and the stationary portion 56 are designed similarly to the respective portions of the cylindricyl rotary furnace. These portions include a stationary intermediate ring 59 as well as inner and outer sealing sleeves 53, 54. These sleeves are of similar construction as the corresponding parts 23, 24 of FIG. 2, and they are likewise acted upon by compressed gas through a channel or passage 60. Still further, cooling passages 58 are provided in the vicinity of the sealing sleeves.

Chamber 50 is connected to the cationary portion 56 through a spring arrangement 67 and a bellows 68. As can be seen, these components are likewise similar to the parts according to FIG. 2.

Additionally, radiation shields 70, 71 shielding the components from the interior of the furnace are provided, with one shield being associated with the rotating portions and the other being associated with the stationary furnace portion. Still further, FIG. 4 also shows part of the brickwork 72 of the interior portion of the furnace.

What we claim is:

1. In a rotating furnace, an internal rotating means carrying parts subjected to heat and internal gases, an outer supporting stationary means supporting the inner rotating means, a sealing assembly means for limiting the leakage of gas and heat from said rotating means, said sealing assembly means comprising: at least one outer sealing sleeve positioned for sealing engagement between said rotating means and said stationary means, means for delivering a barrier gas under pressure to urge said sealing sleeve by pressure contact into said sealing engagement, and an intermediate bearing ring between said internal rotating means and said outer supporting means for absorbing the compression pressure forces therebetween and for acting as a spacer ring between said rotating and stationary means, said intermediate ring sealing a portion of said internal gas from flowing to said outer sealing sleeve.

2. The rotating furnace of claim 1 in which said intermediate ring is formed of a pliable material and acts as a friction or sleeve bearing.

3. The rotating furnace of claim 2 in which said intermediate ring is formed of a material formed of graphite fibers.

4. The furnace according to claim 1 in which a pair of outer sleeves are provided and in which both of said outer sleeves are urged by a barrier gas under pressure into sealing engagement.

5. The furnace according to claim 4 in which said sealing sleeves have a cross section providing an annular profile with an apex contacting a sealing surface, said sealing sleeves being of asymetrical in cross section.

6. The furnace according to claim 5 in which the shorter legs of the annular profile are facing each other with the barrier gas being introduced therebetween.

7. The furnace in accordance with claim 1 including a cooling water channel for having cooler water therein located between said intermediate sealing ring and said outer sealing sleeve.

8. A furnace in accordance with claim 1 in which a plunger loaded burette provides a barrier gas under predetermined pressure.

9. A furnace according to claim 8 in which said burette is provided with an alarming device for signaling when the pressure is low.

* * * * *